US010745816B2

(12) United States Patent
Xu et al.

(10) Patent No.: US 10,745,816 B2
(45) Date of Patent: Aug. 18, 2020

(54) TRANSFER OF VERTICALLY ALIGNED ULTRA-HIGH DENSITY NANOWIRES ONTO FLEXIBLE SUBSTRATES

(71) Applicant: University of Florida Research Foundation, Inc., Gainesville, FL (US)

(72) Inventors: Cheng Xu, Chandler, AZ (US); Kirk Jeremy Ziegler, Gainesville, FL (US); Jie Liu, Greer, SC (US)

(73) Assignee: UNIVERSITY OF FLORIDA RESEARCH FOUNDATION, INC., Gainesville, FL (US)

( * ) Notice: Subject to any disclaimer, the term of this patent is extended or adjusted under 35 U.S.C. 154(b) by 0 days.

(21) Appl. No.: 15/766,589

(22) PCT Filed: Oct. 24, 2016

(86) PCT No.: PCT/US2016/058476

§ 371 (c)(1),
(2) Date: Apr. 6, 2018

(87) PCT Pub. No.: WO2017/074867

PCT Pub. Date: May 4, 2017

(65) Prior Publication Data

US 2018/0298507 A1 Oct. 18, 2018

Related U.S. Application Data

(60) Provisional application No. 62/246,351, filed on Oct. 26, 2015.

(51) Int. Cl.

| | |
|---|---|
| ***C25D 1/00*** | (2006.01) |
| ***C25D 1/04*** | (2006.01) |
| ***C25D 11/04*** | (2006.01) |

(52) U.S. Cl.

CPC ..... *C25D 1/006* (2013.01); *C25D 1/04* (2013.01); *C25D 11/045* (2013.01)

(58) Field of Classification Search

CPC ..... C25D 1/04; C25D 1/006; C25D 11/045

(Continued)

(56) References Cited

U.S. PATENT DOCUMENTS 8,829,767 B2 9/2014 Wang et al.
8,835,285 B2 9/2014 Grimes et al.

(Continued)

FOREIGN PATENT DOCUMENTS

WO 2013192623 12/2013

OTHER PUBLICATIONS

International Search Report in co-pending, related PCT Application No. PCT/US16/, 058476, dated Jan. 3, 2017.

(Continued)

*Primary Examiner* — Brian K Talbot

(74) *Attorney, Agent, or Firm* — Thomas Horstemeyer, LLP

(57) ABSTRACT

Various examples are provided for vertically aligned ultra-high density nanowires and their transfer onto flexible substrates. In one example, a method includes forming a plurality of vertically aligned nanowires inside channels of an anodized alumina (AAO) template on an aluminum substrate, where individual nanowires of the plurality of vertically aligned nanowires extend to a distal end from a proximal end adjacent to the aluminum substrate; removing the aluminum substrate and a portion of the AAO template to expose a surface of the AAO template and a portion of the proximal end of the individual nanowires; depositing an interlayer on the exposed surface of the AAO template and the exposed portion of the individual nanowires; and removing the AAO template from around the plurality of vertically aligned nanowires embedded in the interlayer.

14 Claims, 2 Drawing Sheets

(58) Field of Classification Search
USPC ..... 427/58
See application file for complete search history.

(56) References Cited

U.S. PATENT DOCUMENTS

| | | | | |
|---|---|---|---|---|
| 8,932,940 | B2 | 1/2015 | Wang et al. | |
| 2009/0194424 | A1* | 8/2009 | Franklin | B01J 23/745 205/114 |
| 2009/0242416 | A1* | 10/2009 | Yun | B81B 3/0021 205/181 |
| 2012/0094192 | A1 | 4/2012 | Qu et al. | |
| 2012/0192934 | A1* | 8/2012 | Fan | H01L 31/0296 136/255 |
| 2013/0038299 | A1 | 2/2013 | Sohn et al. | |
| 2013/0062204 | A1* | 3/2013 | Ziegler | B82B 3/0004 204/450 |
| 2014/0128972 | A1 | 5/2014 | Khraiche et al. | |
| 2014/0374268 | A1* | 12/2014 | Wu | C25D 1/04 205/118 |

OTHER PUBLICATIONS

Matefil-Templfli, et al., "Vertically Aligned Nanowires on Flexible Silicone Using a Supported Alumina Template Prepared by Pulsed Anodization" Advanced Materials, vol. 21, 2009, pp. 4005-4010.

"Growth and Transfer of High-Aspect Nanowires onto Flexible Substrates" by Cheng Xu, Yang Zhao, Jie Liu, and Kirk J. Ziegler, 2013 AIChE annual meeting, San Francisco, CA, Nov. 2013.

"Growth and Transfer of Nanowires with High Density and Aspect-Ratio onto Flexible Substrates" by Cheng Xu, Yang Zhao, Shikai Chen, and Jie Liu, 2014 ECS annual meeting, poster session, May 2014 (Abstract Only).

"Metallic Nanowire-Graphine Hybrid Nanostructures for Highly Flexible Field Emission Devices, Nanotechnology" by Muhammad Arif, Kwang Heo, Byung Yang Lee, Joohyung Lee, David H Seo, Sunae Seo, Jikang Jian, & Seunghun Hong, vol. 22, No. 35, Aug. 2011.

Lupan, Oleg, et al., Hydrothermal Treatment for the Marked Structrual and Optical Quality Improvement of ZnO Nanowire Arrays Deposited on Lightweight Flexible Substrates, Journal of Crystal Growth, vol. 312, Issue 16-17, pp. 2454-2458, Aug. 2010.

Matefi-Tempfli, Stefan, et al., "Vertically Aligned Nanowires on Flexible Silicone Using a Supported Alumina Template Prepared by Pulsed Adonization", Advanced Materials, vol. 21, Issue 40, pp. 4005-4010, Jun. 2009.

Shiu, Shu-Chia, et al., "Massive Transfer of Vertically Aligned Si Nanowire Array Onto Alien Substrates and Their Characteristics", Applied Surface Science, vol. 255, Issue 20, pp. 8566-8570, Jul. 2009.

* cited by examiner

TRANSFER OF VERTICALLY ALIGNED ULTRA-HIGH DENSITY NANOWIRES ONTO FLEXIBLE SUBSTRATES

CROSS REFERENCE TO RELATED APPLICATIONS

This application is the 35 U.S.C. 0.371 national stage application of PCT Application No. PCT/US2016/058476, filed Oct. 24, 2016, which claims priority to, and benefit of, U.S. provisional application entitled "Transfer of Vertically Aligned Ultra-High Density Nanowires onto Flexible Substrates" having Ser. No. 62/246,351, filed Oct. 26, 2015, both of which are hereby incorporated by reference in their entireties.

STATEMENT REGARDING FEDERALLY SPONSORED RESEARCH OR DEVELOPMENT

This invention was made with government support under grant number CBET1033736, awarded by the National Science Foundation (NSF). The Government has certain rights in the invention.

BACKGROUND

Wearable technology has gained a tremendous amount of attention in the past decade. According to Forbes, 71% of 16-to-24 year olds want wearable devices. The development of many wearable electronics have already made significant progress as evidenced in popular commercial products such as google glass, smart watches etc.

SUMMARY

Embodiments of the present disclosure are related to vertically aligned ultra-high density nanowires and their transfer onto flexible substrates.

In one embodiment, among others, a method comprises forming a plurality of vertically aligned nanowires inside channels of an anodized alumina (AAO) template on an aluminum substrate, where individual nanowires of the plurality of vertically aligned nanowires extend to a distal end from a proximal end adjacent to the aluminum substrate; removing the aluminum substrate and a portion of the AAO template to expose a surface of the AAO template and a portion of the proximal end of the individual nanowires; depositing an interlayer on the exposed surface of the AAO template and the exposed portion of the individual nanowires; and removing the AAO template from around the plurality of vertically aligned nanowires embedded in the interlayer. In one or more aspects of these embodiments, the method can comprise forming a flexible substrate on a side of the interlayer opposite the plurality of vertically aligned nanowires embedded in the interlayer prior to removing the AAO template. The flexible substrate can comprise polydimethylsiloxane (PDMS). The method can comprise anodizing an aluminum film to form the AAO template on the aluminum substrate.

In one or more aspects of these embodiments, the plurality of vertically aligned nanowires inside the channels of the AAO template can be synthesized by electrodeposition, sol-gel, hydrothermal or chemical vapor deposition. The portion of the proximal end of the individual nanowires can be exposed by etching away the portion of the AAO template. The interlayer can be deposited on the exposed surface of the AAO template and the exposed portion of the individual nanowires by e-beam deposition, thermal evaporation deposition, or sputter deposition. The interlayer can be a conductive interlayer. The conductive interlayer can comprise gold (Au), silver (Ag), or indium tin oxide (ITO).

In one or more aspects of these embodiments, the interlayer can be deposited on the exposed surface of the AAO template and the exposed portion of the individual nanowires by spin coating. The interlayer can comprise a conductive polymer. The conductive polymer can comprise PEDOT:PS or poly(3,4-ethylenedioxythiophene) polystyrene sultanate. The interlayer can be annealed after deposition by spin coating. Charges can be applied to tips of the plurality of vertically aligned nanowires using an electrostatic repulsion technique. The plurality of vertically aligned nanowires can have a density of about $10^{11}$ nanowires/cm$^2$.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
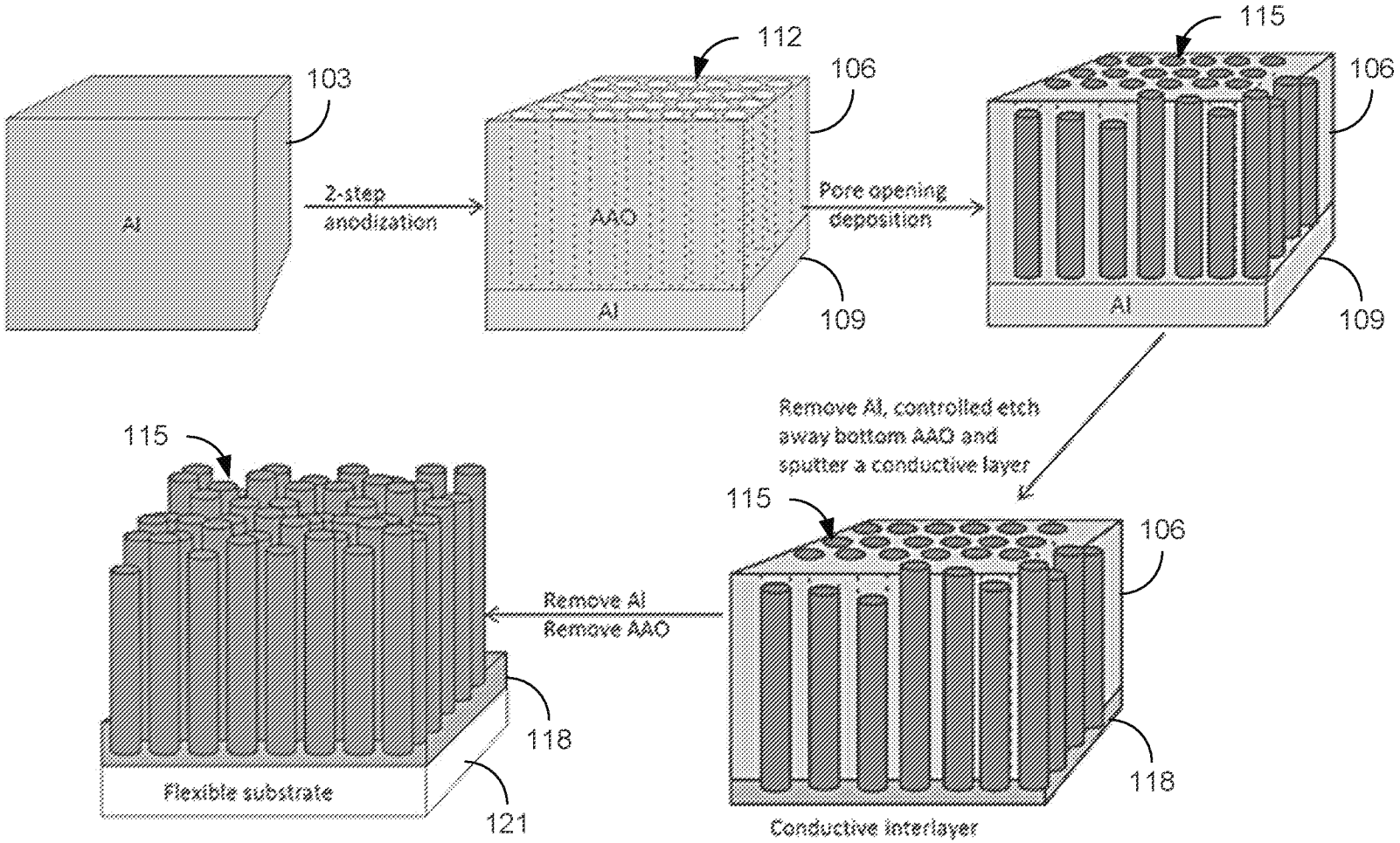
FIG. 1 is a graphical representation illustrating an example of a process for transferring nanowires to a flexible substrate in accordance with various embodiments of the present disclosure.

Disclosed herein are various examples related to the transfer of vertically aligned ultra-high density nanowires on flexible substrates. Reference will now be made in detail to the description of the embodiments as illustrated in the drawings, wherein like reference numbers indicate like parts throughout the several views.

Among all the wearable technologies, flexible devices have shown promise as future electronics, photovoltaics, and sensors. For instance, future sensors can be integrated onto the work uniform to detect toxic gases. Future photovoltaics can be integrated onto clothing that can be used to charge portable electronic devices like mobile phones. However, the current technology is limited by the inability to manufacture efficient, cost-effective flexible devices.

Integrating nanowires onto flexible devices to enhance efficiency has gained considerable research interest in the recent years. Nanowire-based devices provide much larger surface area for photon-electron conversion or gas molecule absorption. Unlike a nanoparticle network for which electron transport is often dictated by random diffusion, a nanowire network provides direct electron transport to the electron-collecting electrode that is ideal for flexible devices such as those mentioned above. The direct growth of nanowires on the flexible substrate however, remains challenging. The most widely-used nanowire growth methods, such as vapor-liquid-solid and vapor-solid-solid mechanisms, utilize high temperatures well above the melting temperature of a polymer substrate. Nanowires grown using hydrothermal methods lack the ability to control critical dimensional parameters, including the diameter, spacing, and density, due to the poor wetting property of polymer substrates.

Here, a template approach has been developed to control the density and length of nanowires and then transfer them onto a flexible substrate with the nanowires vertically attached. FIG. 1 is a graphical representation illustrating an example of the transfer process. Beginning with an aluminum (Al) plate 103, the fabrication of an anodized alumina (AAO) template 106 on an aluminum foil (or substrate) 109 is shown. The AAO 106 is a nanoporous template with vertical channels (or pores) 112 that can have a pore density of about $10^{11}$ pores/cm$^2$. Nanowires 115 are deposited into the pore channels 112 using electrodeposition, sol-gel, or vapor deposition methods depending on the materials of nanowires 115. After removing the aluminum substrate 109, chemical etching of the alumina surface can be applied to expose the tips of nanowires 115. A conductive interlayer 118 can be deposited on the exposed surface of the AAO 106 and nanowires 115 as an electrode material. The nanowires 115 can be transferred to one or more flexible materials using the conductive interlayer 118 as an adhesion layer. Finally, the AAO 106 can be removed to yield the final flexible substrate 121.

Preparation of AAO template. AAO templates 106 have been prepared using a two-step anodization process. Ultrapure aluminum film 103 (e.g., 99.99% purchased from Goodfellow Inc.) was degreased by sonication in soap water, acetone, and ethanol for 20 minutes each. The film 103 was electropolished in a solution (e.g., Electro Polish System Inc.) at 65° C. using a constant voltage of 17 V for 20 minutes. After that, the first anodization was carried out in a 0.3M oxalic acid solution with vigorous stirring at 15° C. using a constant voltage of 40V for 16 hours. After stripping off the anodized AAO layer 106 in a mixture of 10 wt % phosphoric acid and 1.8 wt % chromic acid, the pattern of perfectly arranged ordered nanopores (vertical channels) 112 started to form. The second anodization was done using the same conditions as the first anodization, and the anodization time was varied to control the final thickness of the AAO template 106 with a rate estimated to be 5 μm per hour. The pore size, density, pore ordering, and/or interpore distance depend on the types of electrolyte, concentration of electrolyte, temperature, and anodization voltage. At the end of second anodization, the voltage was reduced at a rate of 1 V per minute to thin the barrier layer. The pore opening was carried out in the 5 wt % phosphoric acid at room temperature. An electrochemical setup (e.g., VersaStat 3, Princeton Applied Research) was used to monitor the pore opening process, for which a small voltage of 0.1 V was applied against a carbon counter electrode. The current was monitored carefully so that the pore opening process was stopped when the current increased dramatically indicating that the pores were fully opened.

Nanowire Synthesis. The nanowires 115 can be deposited inside the pores (vertical channels) 112 onto the exposed aluminum substrate 109 using electrodeposition, sol-gel, and/or vapor-phase depositions. For metals, gold, silver, and platinum were purchased from Technic Inc. The deposition temperature was held at 65° C., and the deposition was performed potentiostatically against a piece of platinum film as a counter electrode in a range from about −0.5 V to about −0.7 V versus a saturated calomel reference electrode. The deposition bath of Cu and Ni was prepared using 100 mL $H_2O$ with 10 g $CuSO_4$ and 4 g sulfuric acid and 100 mL $H_2O$ with 10 g $NiSO_4$ and 4.5 g boric acid, respectively. The deposition condition for Cu was −0.1 V~−0.5 V at room temperature and −1 V~−1.5 V for Ni also at room temperature. In one embodiment, ZnO nanowires 115 were deposited inside the AAO template 106 using vapor-solid growth, for which a crucible containing zinc acetate dehydrate as the source material and the substrate, with the AAO side facing down, was placed in a convective oven at fixed temperature of about 450° C. to about 600° C. The heating rate was set to be 5 degree per minute. The length of nanowires depends on the template thickness, deposition conditions and deposition time. The diameter, density, and ordering of nanowires 115 are identical to the channels 112 in the AAO template 106.

Nanowire transfer. After synthesizing the nanowires 115 embedded in the AAO template 106, the aluminum is removed using $CuCl_2$ with a concentration of 15 g in 150 mL and 50 mL of HCl, leaving nanowire 115/AAO 106 composite standing alone. The bottom side of nanowire 115/AAO 106 composite can be exposed to 1M NaOH solution to etch away a small part of AAO template 106, with an etching time from about one minute to about five minutes. The length of the nanowire tips that are exposed depends on the etch time. Then, a thin film of conductive interlayer material can be deposited on the tips of nanowires 115 to have the nanowires 115 embedded in the conductive interlayer 118. Metal interlayer materials such as, e.g., gold (Au), silver (Ag), and/or indium tin oxide (ITO) can be deposited using e-beam, thermal evaporation, or sputter deposition. A conductive polymer (e.g., PEDOT:PS or poly(3,4-ethylenedioxythiophene) polystyrene sulfonate) can also be used to form the conductive interlayer 118, and can be deposited using spin coating followed by annealing. The flexible back supporting substrate 121 was applied on top of the conductive interlayer 118. The methods of deposition depend on the materials of the conductive interlayer 118 and/or the flexible substrate 121. For the case of polydimethylsiloxane (PDMS), a mixture of PDMS solution and its curing agent (e.g., Skylard 184 encapsulation kit) at a 10:1 ratio was applied on top of the conductive interlayer 118. The sample was left at room temperature for at least 24 hours or annealed at 80° C. for at least an hour. After that, the AAO template 106 was removed using either NaOH or phosphoric acid solution. Lastly, an electrostatic repulsion technique was used to apply charges onto the nanowire tips so that aggregation of nanowires 115 during drying could be avoided.

Figures 2A, 2B, 2C, 2D:
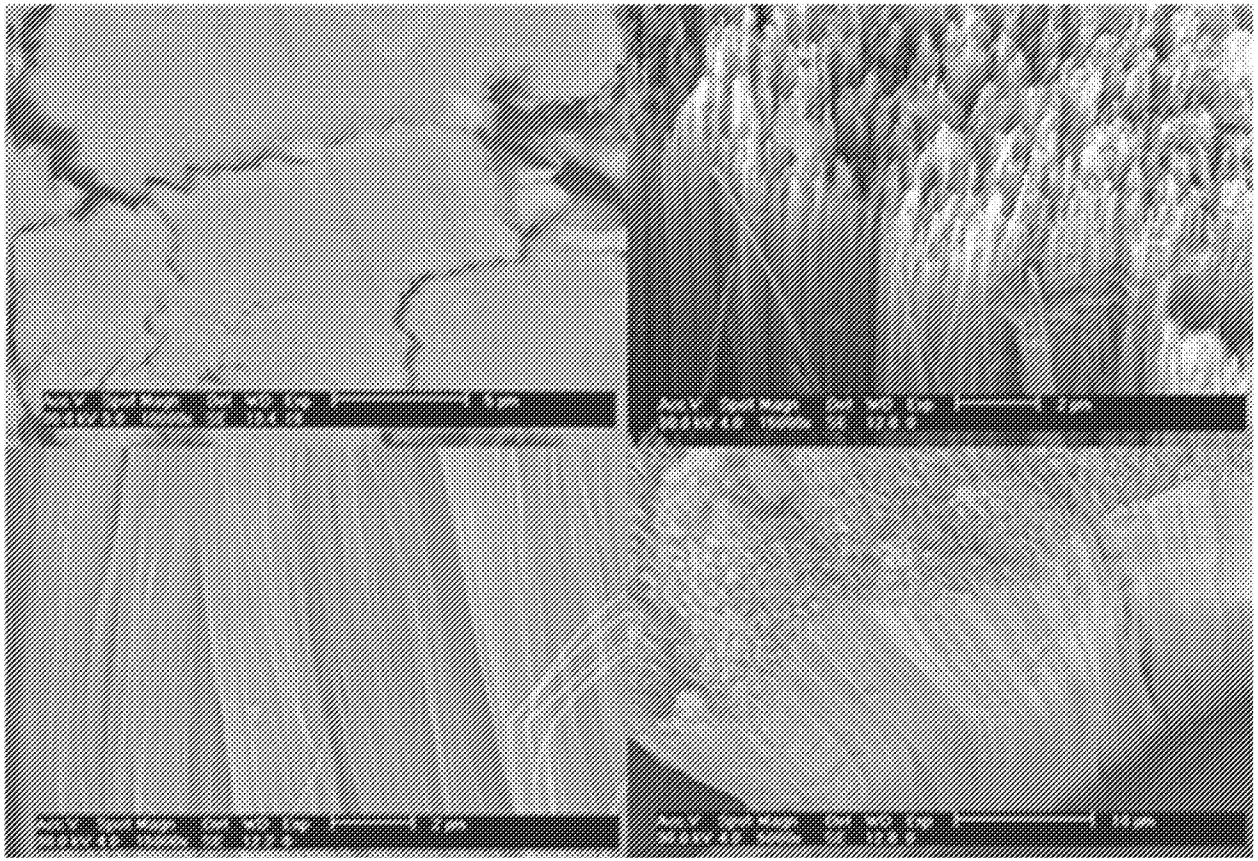
FIGS. 2A through 2D are scanning electron microscope (SEM) images of an example of vertically aligned ultra-high density nanowires on a flexible substrate that were fabricated using the process of FIG. 1 in accordance with various embodiments of the present disclosure.

Referring to FIGS. 2A through 2D, shown are scanning electron microscope (SEM) images of Au nanowires 115 (FIG. 1) after transfer onto a PDMS substrate 121 (FIG. 1). FIGS. 2A and 2B provide top and side views of the nanowires 115 (magnification of 10000× and 15000×), respectively. FIGS. 2C and 2D provide prospective views of the nanowires 115 at a magnification of 5000× and 15000×, respectively. As can be seen, the vertically aligned nanowires 115 have an ultra-high density (about $10^{11}$ nanowires/$cm^2$) with a relatively uniform length.

A simple and inexpensive technique has been introduced for fabricating vertically aligned nanowires 115 with an ultra-high density ($10^{11}$ cavities/$cm^2$) and then transferring these nanowires 115 onto a flexible substrate. These flexible nanowire systems can be used in nanowire-based wearable electronics and flexible sensors and energy conversion devices. Using nanowire electrodes offers advantages such as: (1) providing high conductivity and excellent mechanical properties; (2) maintaining shape and conductivity while bending or stretching the device; (3) providing a direct path for electron transport and shorter diffusion length; and (4) providing ultra-high surface area to maximize efficiency of energy conversion devices. Additionally, to maximize device performance for sensors and energy conversion devices such as photovoltaics and piezoelectrics, it is desirable to have nanowires with high density and vertically aligned morphology. The disclosed method overcomes some of the difficulties encountered in fabricating vertically aligned nanowires directly on a flexible substrate and even more so to produce nanowires with high density.

A method to fabricate nanowires 115 using anodized alumina (AAO) as a template (e.g., a nanoporous template with ultra-high density) has been presented that can overcome these difficulties. This includes the transfer of nanowires 115 onto a flexible substrate 121 and embedding the nanowires 115 into a conductive interlayer 118 (FIG. 1) to reduce contact resistance at the nanowire/electrode interface. The dimensions of the nanowires 115 can be tuned from about 10 nm to about 500 nm in diameter, and the length can be varied depending on the thickness of AAO template 106 (FIG. 1). The nanowires 115 can be deposited into AAO template 106 using various methods including electrodeposition, sol-gel, hydrothermal, and/or chemical vapor deposition. Depending on the methods of deposition, metals, semiconductors and/or polymers can be deposited into AAO template 106 to form the nanowires 115. The disclosed method is versatile and can improve the fabrication of nanowire-based flexible devices.

The flexible nanowire structure offers many competitive advantages. First, vertically aligned nanowires with an ultra-high density can be produced on a flexible substrate, which has been challenging in this field. This can allow for the fabrication of flexible sensors, photovoltaics, and piezoelectric devices with high performance. Nanowire-based flexible devices can maintain excellent conductivity and mechanical properties while bending or stretching the device. Second, the method is versatile in terms of methods of deposition and choices of deposited materials, which reduce the constraints since the flexible substrate is generally not able to withstand high temperature. Third, the embedded nanowires in the conductive electrode materials can reduce the contact resistance at nanowire/electrode interface. The flexible nanowire structure can be used in numerous flexible devices including wearable electronics, flexible display, and energy conversion devices.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A method, comprising:

forming a plurality of vertically aligned nanowires inside channels of an anodized alumina (AAO) template on an aluminum substrate, where individual nanowires of the plurality of vertically aligned nanowires extend to a distal end from a proximal end adjacent to the aluminum substrate;

removing the aluminum substrate and a portion of the AAO template adjacent to the aluminum substrate to expose a surface of the AAO template and a portion of the proximal end of the individual nanowires, the exposed surface formed on a remaining portion of the AAO template by the removal of the portion of the AAO template, where the plurality of vertically aligned nanowires are retained in alignment by the channels of the remaining portion of the AAO template with the portion of the proximal ends of the individual nanowires exposed;

depositing a conductive interlayer on the exposed surface of the AAO template and the exposed portion of the individual nanowires, the vertically aligned nanowires embedded in the conductive interlayer deposited between the exposed proximal ends of adjacent nanowires;

forming a flexible substrate on a surface of the conductive interlayer opposite the plurality of vertically aligned nanowires embedded in the conductive interlayer; and removing the remaining portion of the AAO template from around the plurality of vertically aligned nanowires embedded in the conductive interlayer after forming the flexible substrate.

2. The method of claim 1, wherein the flexible substrate comprises polydimethylsiloxane (PDMS).

3. The method of claim 1, further comprising anodizing an aluminum film to form the AAO template on the aluminum substrate.

4. The method of claim 1, wherein the plurality of vertically aligned nanowires inside the channels of the AAO template are synthesized by sol-gel, hydrothermal or chemical vapor deposition.

5. The method of claim 1, wherein the portion of the proximal end of the individual nanowires is exposed by etching away the portion of the AAO template that is exposed by the removal of the aluminum substrate.

6. The method of claim 1, wherein the conductive interlayer is deposited on the exposed surface of the AAO template and the exposed portion of the individual nanowires by e-beam deposition, thermal evaporation deposition, or sputter deposition.

7. The method of claim 1, wherein the conductive interlayer comprises gold (Au), silver (Ag), or indium tin oxide (ITO).

8. The method of claim 1, wherein the conductive interlayer is deposited on the exposed surface of the AAO template and the exposed portion of the individual nanowires by spin coating.

9. The method of claim 8, wherein the conductive interlayer comprises a conductive polymer.

10. The method of claim 9, wherein the conductive polymer comprises PEDOT:PS or poly(3,4-ethylenedioxythiophene) polystyrene sulfonate.

11. The method of claim 8, wherein the conductive interlayer is annealed after deposition by spin coating.

12. The method of claim 8, wherein charges are applied to tips of the plurality of vertically aligned nanowires using an electrostatic repulsion technique.

13. The method of claim 1, wherein the plurality of vertically aligned nanowires have a density of about $10^{11}$ nanowires/$cm^2$.

14. The method of claim 1, wherein the plurality of vertically aligned nanowires inside the channels of the AAO template are synthesized by electrodeposition.

* * * * *